US007189020B2

(12) United States Patent
Chen

(10) Patent No.: US 7,189,020 B2
(45) Date of Patent: Mar. 13, 2007

(54) PUSHBUTTON CONTROLLED CORRECTION TAPE ASSEMBLY

(75) Inventor: Jau-Shyong Chen, Chang Hua (TW)

(73) Assignee: SDI Corporation (TW)

( * ) Notice: Subject to any disclaimer, the term of this patent is extended or adjusted under 35 U.S.C. 154(b) by 50 days.

(21) Appl. No.: 11/127,355

(22) Filed: May 12, 2005

(65) Prior Publication Data

US 2006/0257195 A1 Nov. 16, 2006

(51) Int. Cl.
*B43L 19/00* (2006.01)

(52) U.S. Cl. ..... 400/697; 400/697.1; 400/695

(58) Field of Classification Search ..... 400/695, 400/697, 697.1, 700–702; 118/74, 76, 200; 401/16–17, 20, 29, 31, 33, 195; 156/577, 156/579; 242/588.3; 483/59
See application file for complete search history.

(56) References Cited

U.S. PATENT DOCUMENTS 5,713,680 A * 2/1998 Yoshino et al. ..... 401/30
6,729,377 B2 * 5/2004 Huthmacher ..... 156/577

FOREIGN PATENT DOCUMENTS

JP 2004-130746 * 4/2004

* cited by examiner

*Primary Examiner*—Judy Nguyen
*Assistant Examiner*—N. Ha
(74) *Attorney, Agent, or Firm*—Jackson Walker, LLP

(57) ABSTRACT

A pushbutton controlled correction tape assembly includes a casing having therein a correction tape assembly having an application head, a pushbutton assembly received in the casing to selectively extend the application head of the correction tape assembly out of the casing so as to apply a correction tape to a surface.

7 Claims, 9 Drawing Sheets

PUSHBUTTON CONTROLLED CORRECTION TAPE ASSEMBLY

BACKGROUND OF THE INVENTION

1. Field of the Invention

The present invention relates to a correction tape assembly, and more particularly to a correction tape which is controlled by a pushbutton assembly.

2. Description of Related Art

Correction tapes are extensively used in writing and typing whenever there is an error. The user places the correction tape on top of the place where the error is and then presses and moves the correction tape to allow the correction tape to adhere to the surface to cover the error. Thereafter, the user is able to write/type on the corrected portion. The introduction of such correction tape simplifies correcting paperwork because the user no longer needs to retype or rewrite the entire article just for a small mistake.

The mostly commonly known correction tape assembly has a casing and a reel rotatably received in the casing. When the correction tape assembly is employed on a surface, the coating on a paper belt is adhered to the surface and the paper belt is reeled backward by the reel. The convenience of this correction tape is proved to be valid. However, the white coating on the paper belt is easily stained such that often the user will have to skid over a portion of the correction tape (to reel back in the casing a portion of the correction tape) for application of a clean coating. To overcome the disadvantage of the existing correction tape being easily polluted, a different correction tape assembly is provided to the market. This correction tape has a cover removably mounted on the casing so that when the correction tape is not in use, the cover is able to encase the correction tape so as to prevent the correction tape from being polluted and when the correction tape is in application, the user is able to remove the cover to reveal the correction tape for use. Indeed, the removable cover solves the pollution problem, but the convenience element no longer exists. That is, the user will have to remove the cover first to apply the correction tape onto the surface. When the cover is lost, the correction tape assembly again is easily polluted.

To overcome the shortcomings, the present invention tends to provide an improved correction tape assembly having a controlling pushbutton assembly to mitigate the aforementioned problems.

SUMMARY OF THE INVENTION

The primary objective of the present invention is to provide a pushbutton assembly to control the extension of the correction tape so that the user is able to easily apply the correction tape as required.

Another objective of the present invention is that the correction tape assembly has an application head through which the correction tape runs over. The application head is pivotable relative to the correction tape assembly so that the user is able to easily apply the correction tape to wherever required.

In still another objective of the present invention, the correction tape assembly has a pushbutton assembly mounted inside the correction tape assembly to control extension of the application head so that the correction tape is protected from pollution when the correction tape is not in use.

In one aspect of the present invention, the pushbutton assembly has a pushbutton movably mounted inside the casing, a driven tube engaged with the pushbutton and having multiple slanted teeth formed on an inner periphery of the driven tube, multiple sliding keyways and multiple recesses both intermittently formed on the inner periphery of the driven tube to sandwich each slanted tooth, a rotation tube rotatably received in the driven tube and having multiple guiding ribs formed on an outer periphery of the rotation tube to correspond to the sliding keyways of the driven tube and multiple first serrated teeth formed on a distal edge thereof and a control tube movably received inside the driven tube and having multiple second serrated teeth formed on an outer periphery of the control tube and multiple control ribs formed on the outer periphery of the control tube to correspond to the sliding keyways of the driven tube so as control the rotation of the rotation tube such that when the control ribs are received in the recesses and stopped by bottom faces defining the recesses of the driven tube, the control tube is extended relative to the driven tube and when the control ribs are received in the sliding keyways of the driven tube, the control tube is retracted with respect to the driven tube.

Other objects, advantages and novel features of the invention will become more apparent from the following detailed description when taken in conjunction with the accompanying drawings.

DETAILED DESCRIPTION OF THE PREFERRED EMBODIMENT

Figure 1:
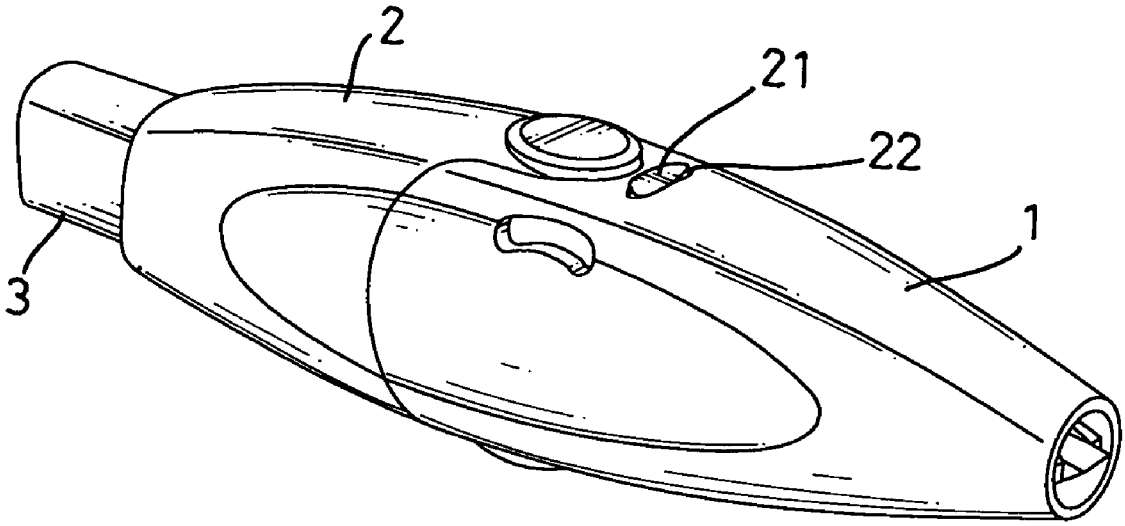
FIG. 1 is a perspective view of the correction tape assembly of the present invention.
Figure 2:
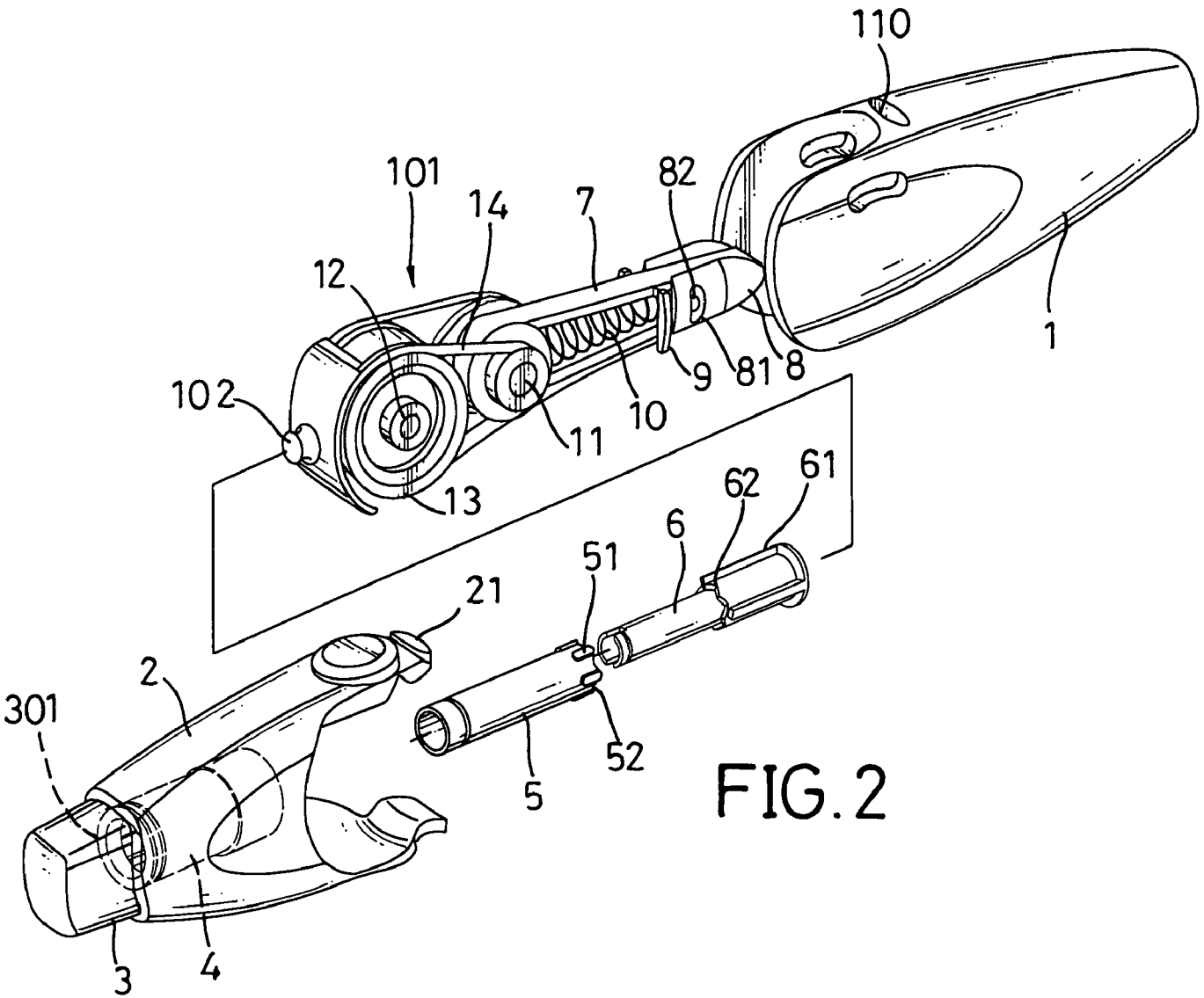
FIG. 2 is an exploded perspective view of the present invention.

With reference to FIGS. 1 and 2, it is noted that the correction tape assembly in accordance with the present invention includes a casing composed of a front cover (1) and a rear cover (2) detachably connected to the front cover (1) to define therebetween a receiving space (not numbered), a pushbutton (3) movably received in the rear cover (2), a pushbutton assembly received in the casing and composed of a driven tube (4), a rotation tube (5) and a control tube (6), a bracket (7) through which a correction tape runs and an application head (8) mounted at a front of the bracket (7).

The front cover (1) has a clamping recess (110) defined in a front face thereof and the rear cover (2) has a ledge with a hook (21) extending out from a side face thereof to correspond to the clamping recess (110) of the front cover (1) so that the front cover (1) and the rear cover (2) are detachably connected to each other to form a casing so as to receive therein the driven tube (4), the rotation tube (5) and the control tube (6). From the depiction of the drawings, it is noted that the casing of the present invention is hollow and has a front opening and a rear opening through which the pushbutton (3) is movably mounted. The pushbutton (3) is provided with a fixing passage (301) defined in the pushbutton (3) to correspond to and receive therein a rear end of the driven tube (4).

Figure 3:
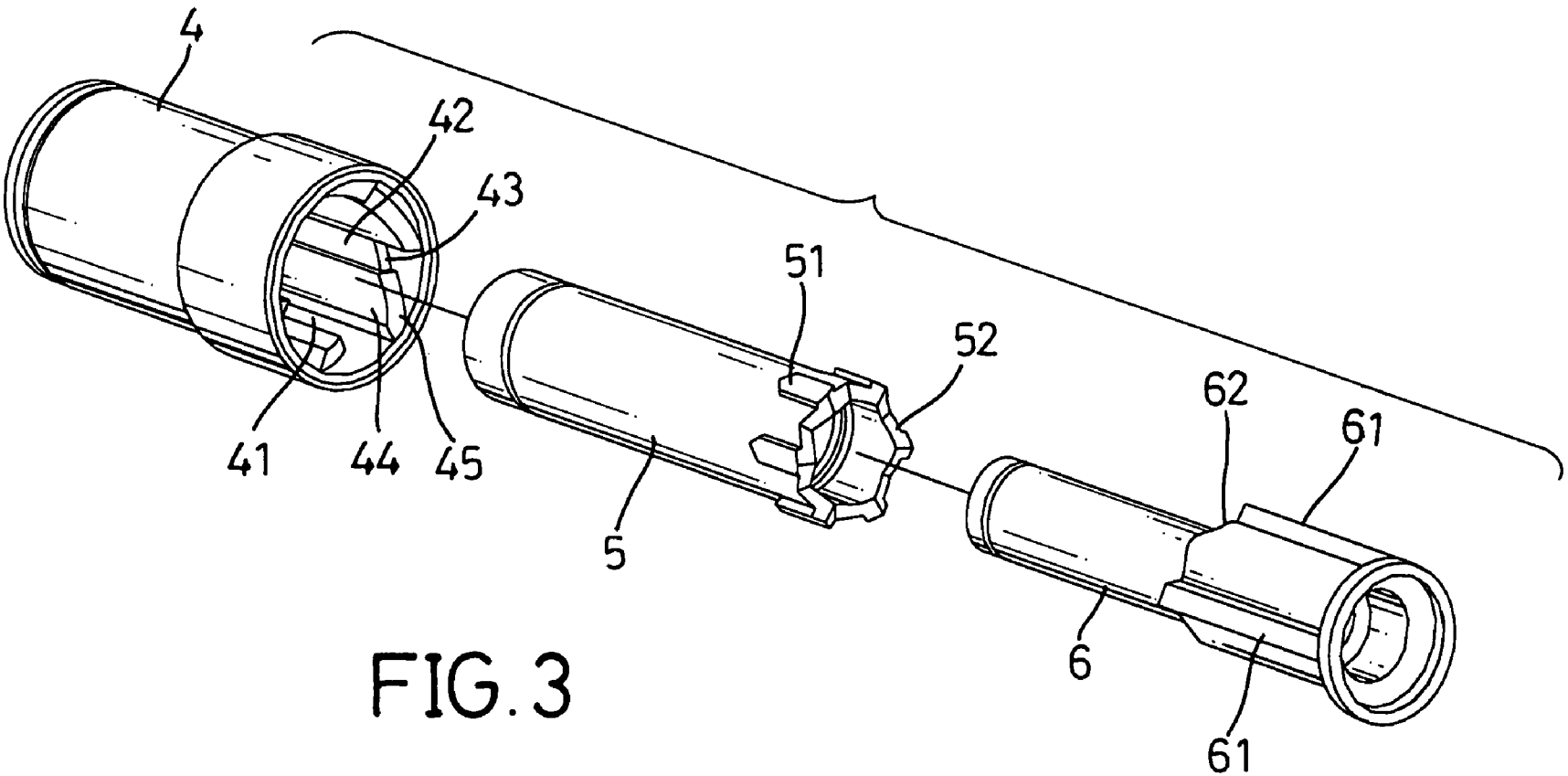
FIG. 3 is an exploded perspective view of the pushbutton assembly of the present invention.
Figure 3A:
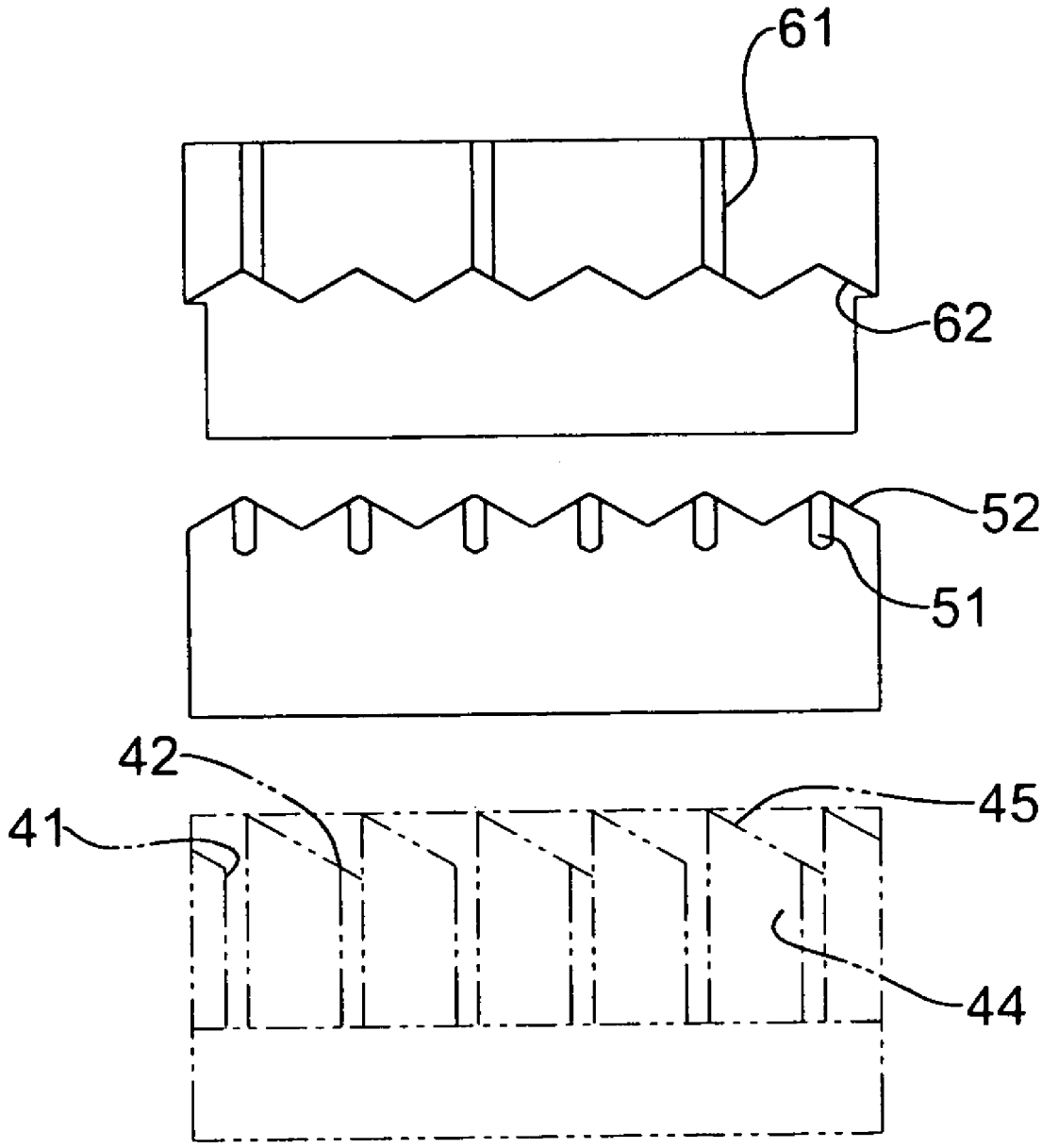
FIG. 3A is a schematic view showing the extension of the driven tube, the rotation tube and the control tube.

With reference to FIGS. 3 and 3A, the driven tube (4) has multiple sliding keyways (41) defined in an inner periphery of the driven tube (4), shallow trenches (42) defined in the inner periphery of the driven tube (4), multiple recesses (43) also defined in the inner periphery of the driven tube (4) and multiple slanted teeth (44) formed on the inner periphery of the driven tube (4) and each slanted tooth (44) having an inclined face (45) formed on top of the slanted tooth (44). Both the sliding keyways (41) and shallow trenches (42) are intermittently defined in the inner periphery of the driven tube (4). That is each slanted tooth (44) is sandwiched by one of the shallow trenches (42) and one of the sliding keyways (41).

The rotation tube (5) has multiple guiding ribs (51) formed on an outer periphery of the rotation tube (5) to respectively correspond to each of the sliding keyways (41) and each of the shallow trenches (42), and multiple first serrated teeth (52) formed on a proximal end of the rotation tube (5). The control tube (6) has multiple control ribs (61) formed on an outer periphery of the control tube (6) to correspond to the sliding keyways (41) and the recesses (43) of the driven tube (4) and multiple second serrated teeth (62) formed on the outer periphery of the control tube (6) to correspond to and mate with the first serrated teeth (52). Each of the driven tube (4), the rotation tube (5) and the control tube (6) has two open ends. The rear end of the control tube (4) is received in the fixing passage (301) of the pushbutton (3). A rear end of the rotation tube (5) is received in the driven tube (4) to allow the guiding ribs (51) to be temporarily received in the sliding keyways (41)/the shallow trenches (42). A rear end of the control tube (6) is extended into the rotation tube (5) to allow the control ribs (61) to be received in the sliding keyways (41) and the second serrated teeth (62) mated with the first serrated teeth (52) of the rotation tube (5).

Figure 4:
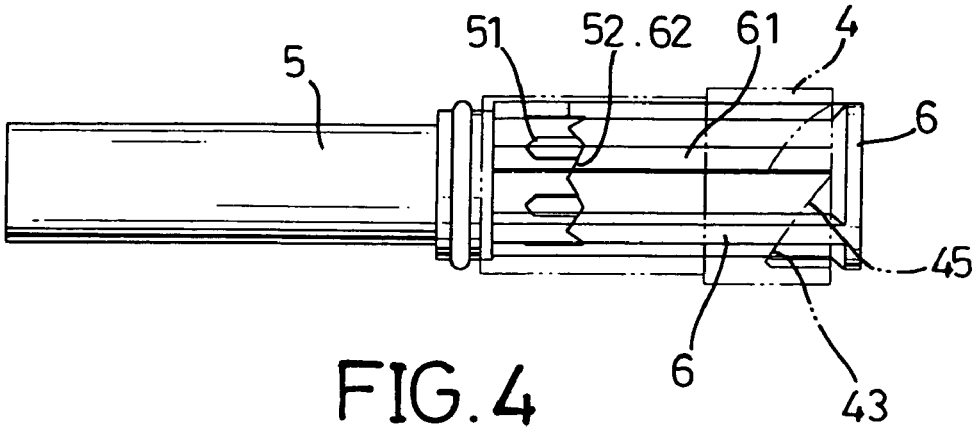
FIG. 4 is a schematic view showing the relative position among the control tube, the rotation tube and the control tube when the control tube is retracted relative to the driven tube.
Figure 5:
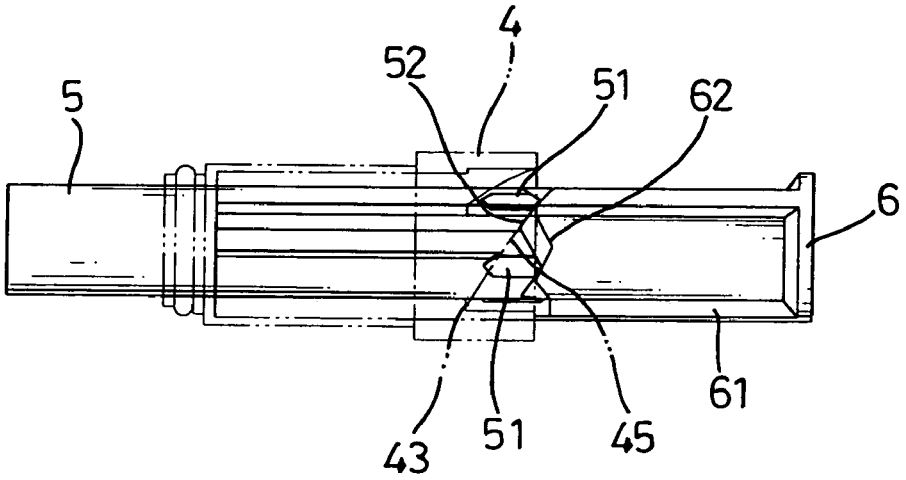
FIG. 5 is a schematic view showing the relative position among the control tube, the rotation tube and the control tube.
Figure 6:
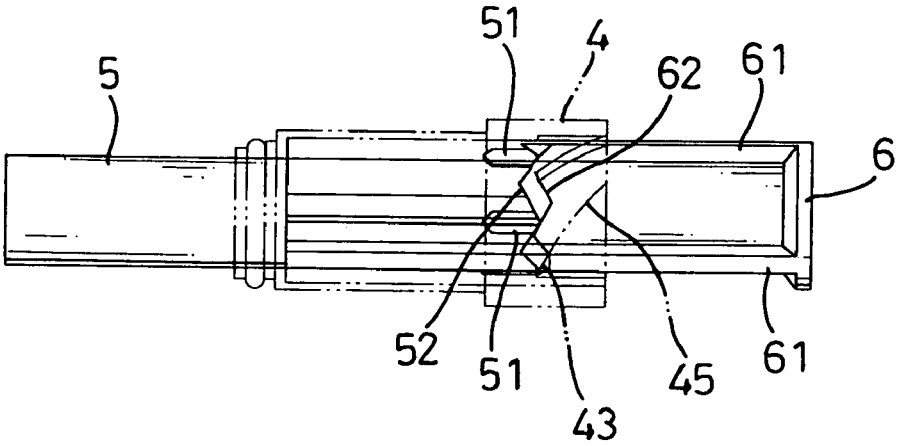
FIG. 6 is a schematic view showing the relative position among the control tube, the rotation tube and the control tube when the control tube is extended relative to the driven tube.
Figure 4A:
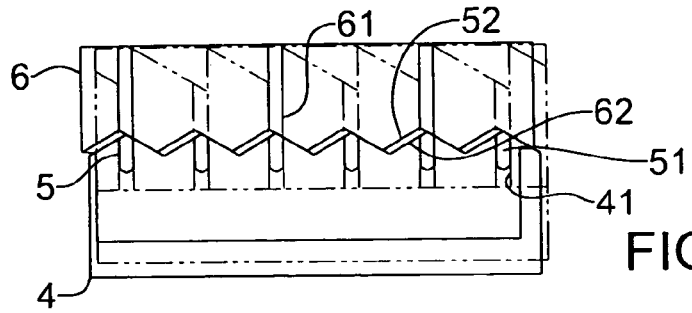
FIG. 4A is a schematic view showing interaction among the driven tube, the rotation tube and the control tube corresponding to FIG. 4.
Figure 5A:
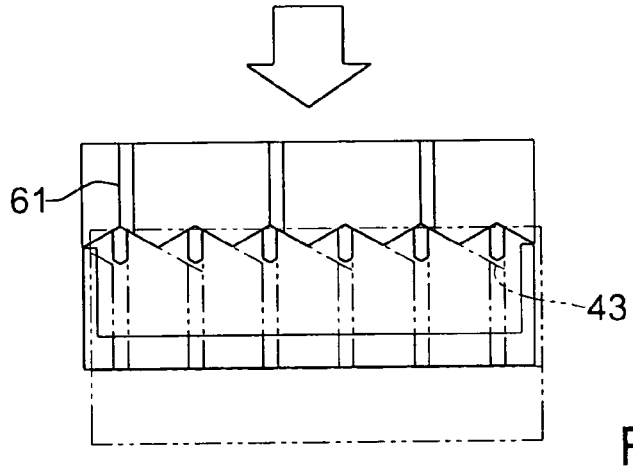
FIGS. 5A and 5B are schematic views showing interaction among the driven tube, the rotation tube and the control tube corresponding to FIG. 5.
Figure 5B:
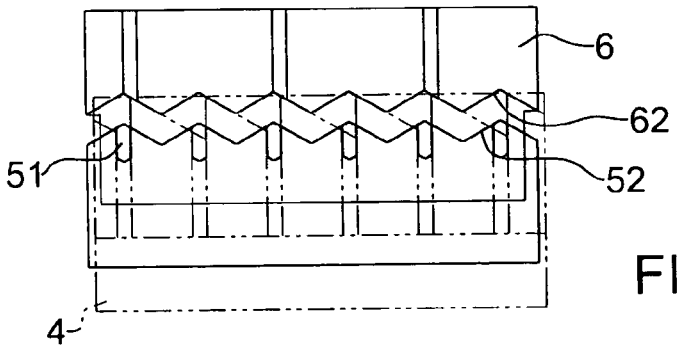
Figure 6A:
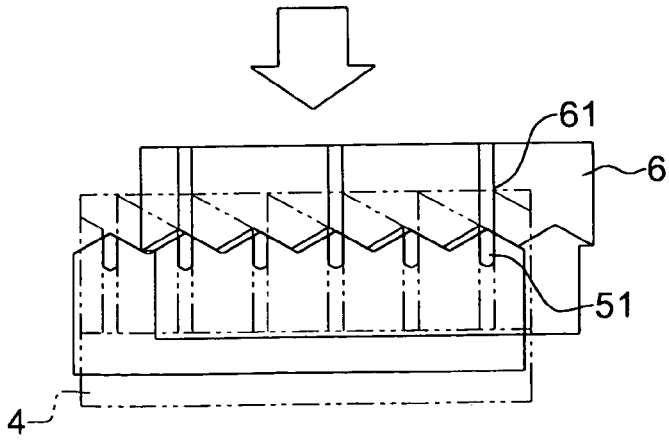
FIG. 6A is a schematic view showing interaction among the driven tube, the rotation tube and the control tube corresponding to FIG. 6.

With reference to FIG. 4 and FIG. 4A, it is noted that when the driven tube (4), the rotation tube (5) and the control tube (6) are assembled, the guiding ribs (51) and the control ribs (61) are received in the sliding keyways (41) of the driven tube (4) and the first serrated teeth (52) of the rotation tube (5) are not exactly mated with the second serrated teeth (62) of the control tube (6). That is, the first serrated teeth (52) are offset to the second serrated teeth (62). When both the rotation tube (5) and the control tube (6) are moved inside the driven tube (4), the guiding ribs (51) and the control ribs (61) are moved inside the sliding keyways (41) of the driven tube (4). However, due to the offset relationship between the first serrated teeth (52) and the second serrated teeth (62), when the rotation tube (5) is pushed by the movement of the pushbutton (3), as shown in FIG. 5A, the control tube (6) is forced to rotate. Thus the control ribs (61) originally received in the sliding keyways (41) are moved to the recesses (43) and eventually stopped by bottom faces defining the recesses (43). After the control ribs (61) are stopped by the bottom faces defining the recesses (43), the control tube (6) is separated from the rotation tube (5) and is extended relative to the driven tube (4), as shown in FIGS. 6 and 6A. Further, the guiding ribs (51) are then movably received in the shallow trenches (42).

Figure 7:
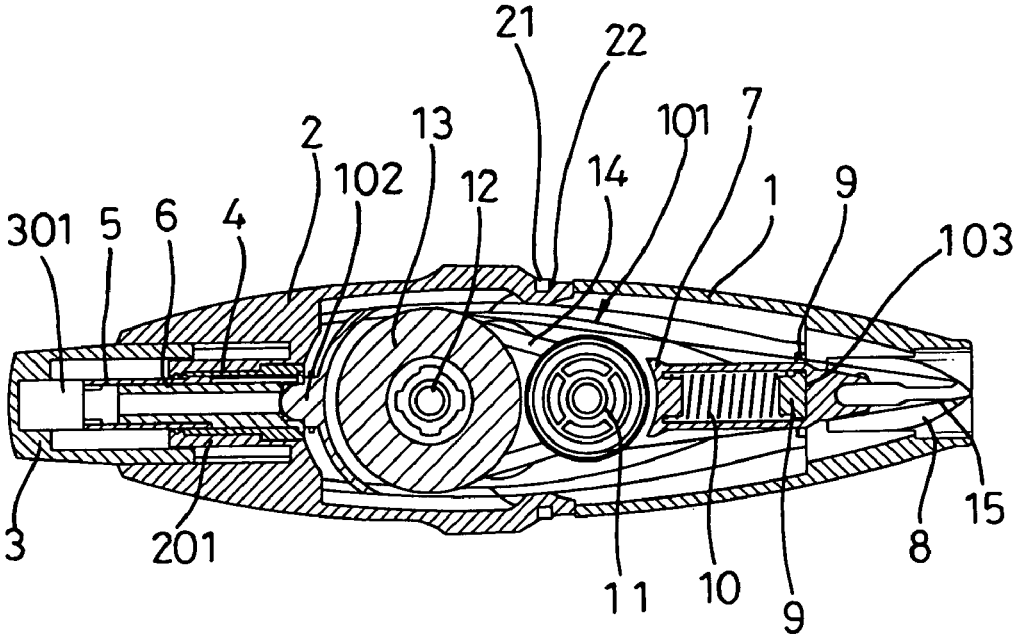
FIG. 7 is a cross sectional view showing the internal structure of the assembled correction tape assembly of the present invention when the application head is retracted inside the casing.
Figure 7A:
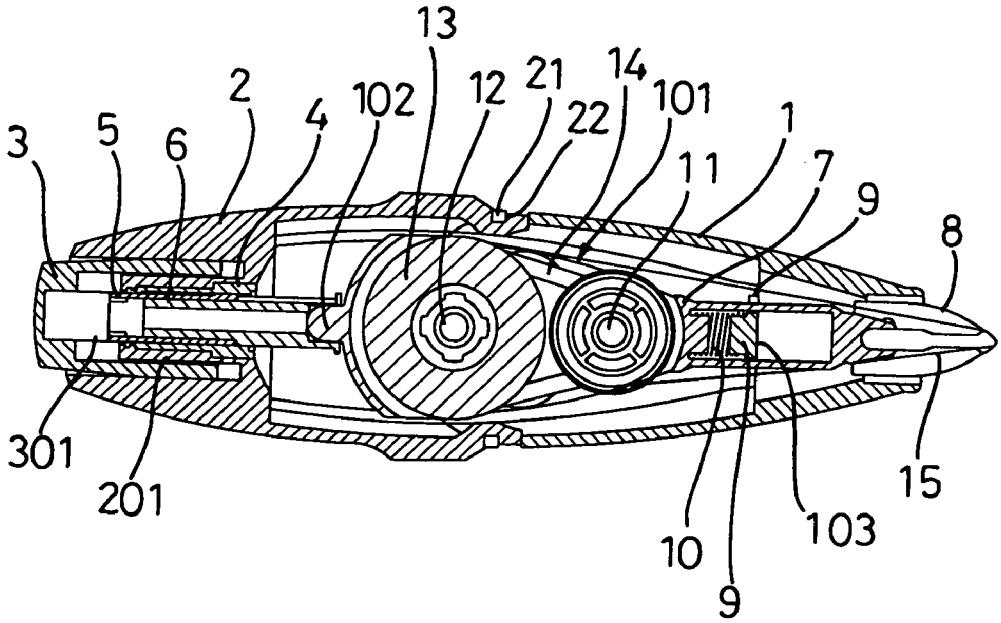
FIG. 7A is a cross sectional view showing that the application head of the present invention is extended out of the casing.

With reference to FIGS. 7 and 7A, it is noted that when the pushbutton (3) is pushed manually, the originally retracted application head (8) is extended from the opening of the front cover (1). Thus, the user is able to readily use the correction tape running over the application head (8). When the pushbutton (3) is pushed again, the control tube (6) as well as the control ribs (61) are forced by the rotation tube (5) to rotate, which aligns the control ribs (61) and the guiding ribs (51) with the sliding keyways (41). Therefore, the control tube (6) as well as the rotation tube (5) is able to be retracted in the driven tube (4).

Referring to FIG. 2 again, it is noted that a correction tape assembly (101) is received inside the front cover (1) and has a first wheel (11) and a second wheel (12) connected to the first wheel (11) via a loop (14). The second wheel (12) has a correction tape (13) mounted therearound. The correction tape assembly (101) further has a bracket (7) extending toward the front opening of the front cover (1) and having a boss (102) formed on a proximate end of the bracket (7) to engage with a distal end of the control tube (6). The bracket (7) has a recoil spring (10) received inside the bracket (7) and a stop (9) formed on a distal end of the recoil spring (10) to allow the recoil spring (10) to be compressed. An application head (8) is pivotally mounted on the distal end of the bracket (7).

Figure 8:
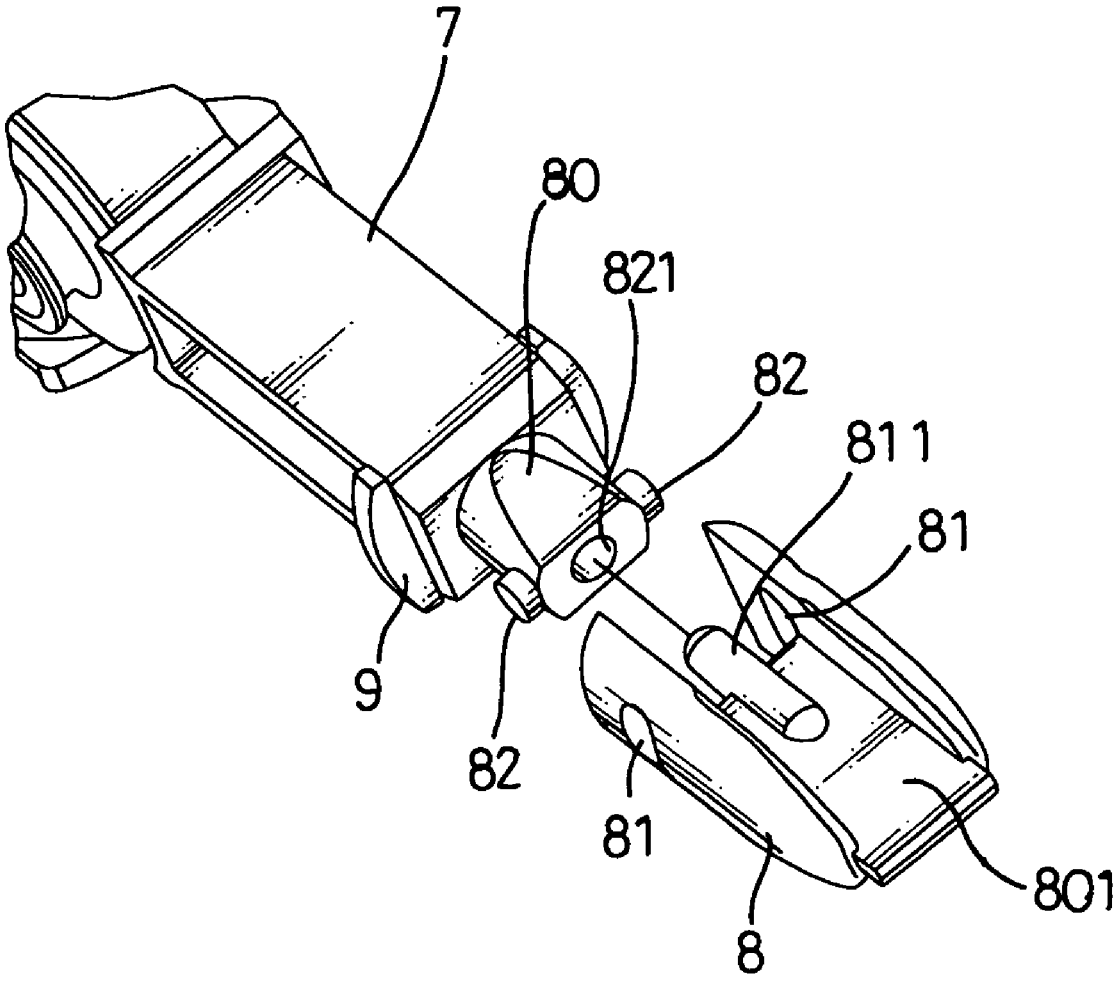
FIG. 8 is an exploded perspective view showing the structure of the application head.
Figure 9:
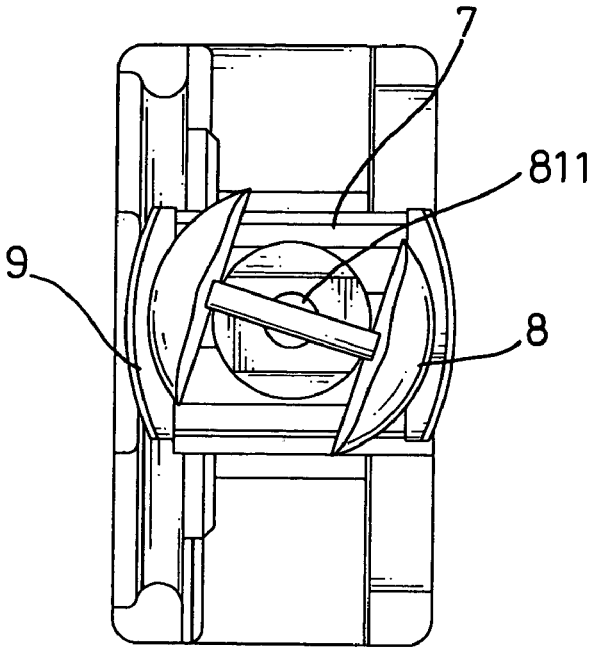
FIG. 9 is a front side view showing the movement of the application head of the present invention.
Figure 10:
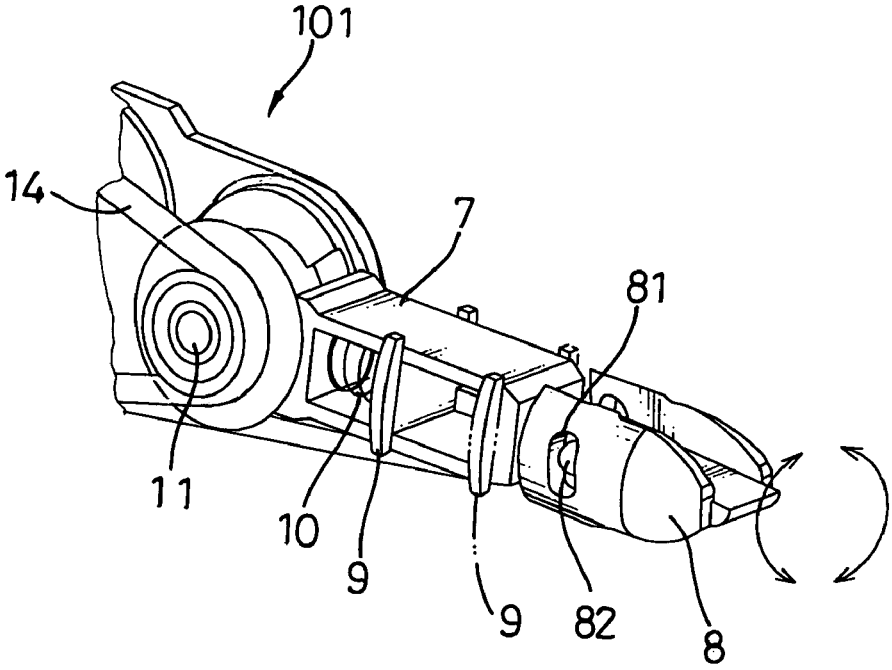
FIG. 10 is a perspective view of the application head.

With reference to FIGS. 8, 9 and 10, the application head (8) includes a connection seat (80) formed on a distal end of the bracket (7) and having two ears (82) respectively formed on two opposed sides of the connection seat (80), a hole (821) defined in the connection seat (80) and a head (801) having two side holes (81) respectively defined in two opposed sides of the head (801) to correspond to the two ears (82) and a connection pole (811) extending toward the hole (821). Thus after the two ears (82) are respectively extended into the corresponding side holes (81) and the connection pole (811) is extended into the hole (821), the head (801) is able to pivot relative to the connection seat (80). Therefore, the correction tape mounted on the second disk (12) is easily applied to places required.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pushbutton controlled correction tape assembly comprising:

a casing having therein a correction tape assembly having an application head;

a pushbutton assembly received in the casing to alternatively extend the application head of the correction tape assembly out of the casing so as to apply a correction tape to a surface, wherein the application head is pivotally connected to the casing and the pushbutton assembly comprises a driven tube integrally formed with the casing, a rotation tube movably received in the driven tube and a control tube rotatably received in the rotation tube and alternatively extending out of the casing for extension of the correction tape out of the casing.

2. The pushbutton controlled correction tape assembly as claimed in claim 1, wherein the correction tape assembly has a boss formed on a proximate end thereof to engage with a distal end of the control tube so that when the control tube is extended relative to the driven tube, the application head is extended out of the casing.

3. The pushbutton controlled correction tape assembly as claimed in claim 2, wherein the driven tube has multiple sliding keyways defined in an inner periphery thereof, multiple shallow trenches defined in the inner periphery of the driven tube to be alternately arranged relative to the sliding keyways, recesses defined in the inner periphery of the driven tube and each recess corresponding to one of the shallow trenches and slanted teeth formed on the inner periphery of the driven tube, the rotation tube movably extended into the driven tube and having multiple guiding ribs formed on an outer periphery of the rotation tube to correspond to the sliding keyways and the shallow trenches and first serrated teeth formed on a distal end of the rotation tube, the control tube has multiple control ribs formed on an outer periphery of the control tube to correspond to the sliding keyways and the recesses of the driven tube and second serrated teeth formed on the outer periphery of the control tube to correspond to the first serrated teeth of the rotation tube, the second serrated teeth being offset to the first serrated teeth such that when the rotation tube is moved inside the driven tube, the control tube is forced to rotate to allow the control ribs to be stopped by the recesses, whereby when both the control ribs and the guiding ribs are received in the sliding keyways, the control tube is retracted inside the driven tube and thus the application head is received in the casing and when the guiding ribs are received in the shallow trenches and the control ribs are stopped by bottom faces defining the recesses, the control tube is extended relative to the driven tube so that the application head is extended out of the casing for application.

4. The pushbutton controlled correction tape assembly as claimed in claim 3, wherein the correction tape assembly includes a bracket having a spring received therein and a stop formed on a distal end of the spring to engage with an inner face of the casing so as to compress the spring to force the control ribs to slide on the slanted teeth such that the control ribs are alternately received in the sliding keyways and the recesses.

5. The pushbutton controlled correction tape assembly as claimed in claim in claim 4, wherein the application head includes a connection seat formed on a distal end of the bracket and having two ears formed on two opposed sides of the connection seat and a head having two side holes defined in two opposed sides of the head to receive therein the two ears and a connection pole extending into a hole defined in the connection seat so that the head is able to pivot relative to the bracket.

6. A pushbutton controlled correction tape assembly comprising:

a casing having therein a correction tape assembly having an application head;

a pushbutton assembly received in the casing to alternatively extend the application head of the correction tape assembly out of the casing so as to apply a correction tape to a surface, wherein the pushbutton assembly comprises a driven tube integrally formed with the casing, a rotation tube movably received in the driven tube and a control tube rotatably received in the rotation tube and alternatively extending out of the casing for extension of the correction tape out of the casing, wherein the application head is pivotally connected to the casing, the correction tape assembly has a boss formed on a proximate end thereof to engage with a distal end of the control tube so that when the control tube is extended relative to the driven tube, the application head is extended out of the casing, wherein the driven tube has multiple sliding keyways defined in an inner periphery thereof multiple shallow trenches defined in the inner periphery of the driven tube to be alternately arranged relative to the sliding keyways, recesses defined in the inner periphery of the driven tube and each recess corresponding to one of the shallow trenches and slanted teeth formed on the inner periphery of the driven tube the rotation tube movably extended into the driven tube and having multiple guiding ribs formed on an outer periphery of the rotation tube to correspond to the sliding keyways and the shallow trenches and first serrated teeth formed on a distal end of the rotation tube the control tube has multiple control ribs formed on an outer periphery of the control tube to correspond to the sliding keyways and the recesses of the driven tube and second serrated teeth formed on the outer periphery of the control tube to correspond to the first serrated teeth of the rotation tube, the second serrated teeth being offset to the first serrated teeth such that when the rotation tube is moved inside the driven tube, the control tribe is forced to rotate to allow the control ribs to be stopped by the recesses, whereby when both the control ribs and the guiding ribs are received in the sliding keyways, the control tube is retracted inside the driven tube and thus the application head is received in the casing and when the guiding ribs are received in the shallow trenches and the control ribs are stopped by bottom faces defining the recesses, the control tube is extended relative to the driven tube so that the application head is extended out of the casing for application.

7. The pushbutton controlled correction tape assembly as claimed in claim 6, wherein the correction tape assembly includes a bracket having a spring received therein and a stop formed on a distal end of the spring to engage with an inner face of the casing so as to compress the spring to force the control ribs to slide on the slanted teeth such that the control ribs are alternately received in the sliding keyways and the recesses.

* * * * *